United States Patent [19]

Schmid et al.

[11] 4,448,167

[45] May 15, 1984

[54] FUEL INJECTION PUMP FOR INTERNAL COMBUSTION ENGINES

[75] Inventors: Werner Schmid, Dischingen; Karl Rapp, Stuttgart, both of Fed. Rep. of Germany

[73] Assignee: Robert Bosch GmbH, Stuttgart, Fed. Rep. of Germany

[21] Appl. No.: 403,197

[22] Filed: Jul. 29, 1982

[30] Foreign Application Priority Data

Aug. 1, 1981 [DE] Fed. Rep. of Germany ..... 3130620
Jun. 29, 1982 [DE] Fed. Rep. of Germany ..... 3224127

[51] Int. Cl.[3] ..... F02M 39/00
[52] U.S. Cl. ..... 123/446; 123/503
[58] Field of Search ..... 123/446, 503, 357, 359; 417/289

[56] References Cited

U.S. PATENT DOCUMENTS

| | | | |
|---|---|---|---|
| 1,944,858 | 1/1934 | Baur | 123/503 |
| 3,677,256 | 7/1972 | Regneault et al. | 123/503 |
| 4,222,717 | 9/1980 | Clouse et al. | 123/503 |
| 4,378,775 | 4/1983 | Straubel et al. | 123/445 |

FOREIGN PATENT DOCUMENTS

| | | | |
|---|---|---|---|
| 2806478 | 8/1979 | Fed. Rep. of Germany | 123/503 |
| 133346 | 12/1978 | German Democratic Rep. | 123/503 |
| 168528 | 6/1932 | Switzerland | 123/446 |
| 550050 | 12/1942 | United Kingdom | 123/503 |

*Primary Examiner*—Ira S. Lazarus
*Assistant Examiner*—Magdalen Moy
*Attorney, Agent, or Firm*—Edwin E. Greigg

[57] ABSTRACT

A fuel injection pump, embodied as a series pump, has a governor rod for rotating a pump piston provided with an oblique control groove. The pump piston further has at least one longitudinal groove, by means of which upon congruence with a fill and relief opening of the pump work chamber, a zero fuel supply can be established. With electrically controlled actuation of the governor rod, the appropriate adjustment of the end stops of the governor rod or the appropriate embodiment of the pump piston assures that the opening comes into congruence with a longitudinal groove adjoining the full-load working zone of the pump piston before the end stop of the governor rod is reached.

6 Claims, 4 Drawing Figures

FUEL INJECTION PUMP FOR INTERNAL COMBUSTION ENGINES

BACKGROUND OF THE INVENTION

The invention relates to a fuel injection pump having a cylinder and a cylindrical pump piston reciprocating within the cylinder, which piston on its outer cylindrical surface includes at least one longitudinal groove extending from one end surface of the piston and at least one oblique groove oriented obliquely relative to the end surface and extending over a portion of the circumference defined by the outer cylindrical surface. The cylinder has at least one opening which can be made congruent with one of the grooves. The congruence is controlled by rotation of the piston, which in turn is effected by a rotational device controlled by an electrical control unit.

In fuel injection pumps of this kind, an orientation of the opening in the cylinder wall is produced with the longitudinal groove and the obliquely oriented groove because of the rotatability of the pump piston between defined stops. The rotatability is effected with the aid of the governor rod, such that in one terminal position of the piston the opening is brought into congruence with the longitudinal groove, and in the other terminal position it is brought into congruence with the pump piston part, which, in a known manner, determines the starting fuel injection quantity of the pumping element. The pump piston part makes this determination, for example, by means of said oblique groove, or by means of an additional starting groove, or by means of omitting said oblique groove on the piston part being in congruence with the opening in the cylinder wall.

In electronically regulated fuel-injection pumps, however, interruption of the satisfactory functioning of the circuit or of the control device increasingly occurs. In these cases, there is the possibility that the pump pistons may be brought into their position of maximum rotation, which is incorrect for the conditions in the internal combustion engine. This can cause an excessive supply of fuel, thus resulting in overspeeding and the destruction of the engine associated with this pump.

OBJECT AND SUMMARY OF THE INVENTION

It is an object of the invention to provide an improved fuel injection pump of the type noted above in which the excess fuel supply associated with malfunctions is avoided. The fuel injection pump according to the invention has the advantage over the prior art that in a simple manner the supply of the maximum fuel quantity to the engine is precluded if there is a failure in the control device. For instance, if the control device fails or malfunctions and the pump piston is rotated in the full-load direction despite the existing partial-load or low-load condition, then should the tendency to adjustment in the full-load direction continue, the relief opening in the cylinder wall comes into congruence with the stop groove, shortly before the adjusting device arrives at the limiting stop on the full-load side. In this case, the engine is shut off. Thus a supply of fuel can be effected only when an intermediate position of the pump piston between the stopping and starting position can be adhered to, which is accomplished with a satisfactorily functioning control device and rotational device. With the least possible expense, an increase in protection against the destruction of an engine driven in this manner is attained.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
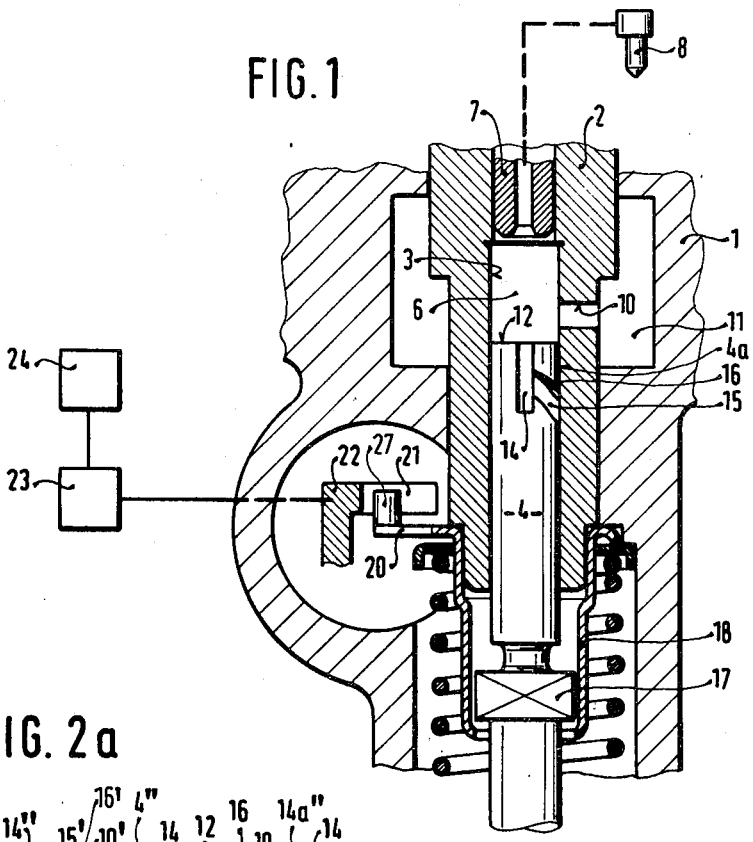
FIG. 1 is a partial section taken through the elements of a fuel injection pump improved in accordance with the present invention.

One pump cylinder 2 per pumping element is inserted into the partially shown housing 1 of a fuel injection pump of a mass-produced type. A pump piston 4 is guided in the cylinder bore 3 of the pump cylinder 2, for reciprocating movement to effect a pumping and an intake stroke, respectively. In the cylinder bore 3, the pump piston 4 defines along with the cylinder 2 and a pressure valve 7 a pump work chamber 6. Fuel is supplied during the supply stroke of the pump piston 4 to a fuel injection valve 8 via the partially shown pressure valve 7.

An opening 10 is provided in the wall of the pump cylinder 2 in the vicinity of the pump work chamber 6, the opening connecting the pump work chamber 6 with a suction chamber 11, at least in the lowermost position of the pump piston 4. The suction chamber 11 surrounds the upper part of the pump cylinder 2. The suction chamber 11 is continuously supplied with fuel by means not further shown, and is subjected to the low supply pressure of a fuel supply pump provided for this purpose.

The pump piston 4 includes an outer cylindrical surface, or jacket face, 4*a*, an end face 12, a longitudinal groove 14 beginning at the end face 12, and a recess, here embodied as an oblique groove 15, branching off from the longitudinal groove 14 and leading obliquely away from the end face 12 of the pump piston 4. The oblique groove 15 extends over a portion of the pump piston jacket face 4*a*. An upper, oblique limitation edge 16 of the oblique groove 15 acts as a control edge, which cooperates with the opening 10. The one part of the oblique groove 15 which is situated next to the end face 12 and to a part 4*b* of the jacket face 4*a* of the pump piston 4 controls the idle fuel injection rate whereas the other parts of the oblique groove control part load and full load as well as starting injection rates.

Figure 3:
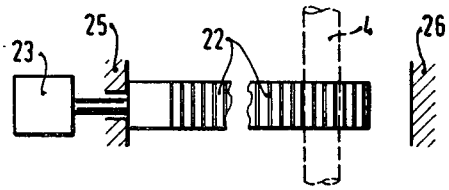
FIG. 3 shows the possible travel of a governor rod for the pump according to the present invention.

On the end of the pump piston 4 protruding out of the pump cylinder 2, the pump piston 4 has a guide face 17, which engages a guide sheath 18. The guide sheath 18 serves as a rotation element of the pump piston 4 and on its part guided within the pump housing 1 it has an arm 20, including a part 27 which is received in and engages a recess 21 of a governor rod 22. The governor rod 22 is actuated by means of an actuation device 23 serving as a rotational device acting upon the pump piston 4. The actuation device 23 is controlled by an electronic control device 24 of known type. The governor rod 22 is adjustable between two end stops 25 and 26, as shown in FIG. 3. In its movement between the stops 25 and 26, the part 27 is engaged by the surface defining the recess 21. Since the movement of the governor rod 22 is maintained in a direction perpendicular to the plane of the paper (FIG. 1), the force applied to the part 27, and consequently to the sheath 18, is offset relative to the longitudinal axis of the piston 4, and consequently rotation of the sheath 18 and piston 4 results.

In addition to the opening 10, the cylinder 2 may have a second opening 10'. In a known fashion, the opening 10, 10' serves as an intake and spill opening. The pump work chamber 6 is filled with fuel which flows through the opening 10, 10' during the intake stroke of the pump piston 4. As soon as the opening 10, 10' is closed by means of the portion of the jacket face 4a of the pump piston 4 following the end edge 12, the supply stroke of the pump piston 4 begins. No supply of fuel can take place if the rotated position of the pump piston 4 is such that the longitudinal groove 14 and the beginning of the oblique limitation edge 16 or the longitudinal groove 14 itself is in congruence with the opening 10 or 10'. If there is congruence, then the entire amount of fuel supplied flows back through the opening 10 or 10' to the suction chamber 11. In intermediate positions of the pump piston 4, the piston executes an effective supply stroke of greater or lesser length until the opening 10, 10' is again opened by the oblique limitation edge, or control edge, 16. By reason of the oblique groove 15 and the longitudinal groove 14, the fuel positively displaced after the end of the supply stroke can then flow back again to the suction chamber 11.

Figure 2A:
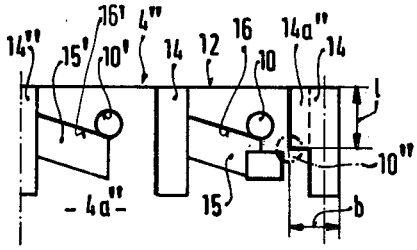
FIG. 2*a* shows a further embodiment of the pump piston shown in FIG. 2.
Figure 2:
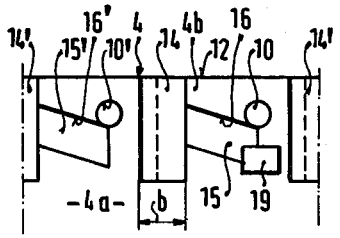
FIG. 2 shows a developed view of various embodiments of a pump piston embodied in accordance with the present invention.

The developed view of the pump piston 4 shown in FIG. 2 depicts a second embodiment of the piston 4, including a second longitudinal groove 14' disposed on the jacket face 4a. The second longitudinal groove 14' is located diametrically opposite the groove 14. The longitudinal groove 14, conventionally designated as a stop groove, is substantially wider than the normal width, indicated by dashed lines in FIG. 2. With the aid of the governor rod 22, this pump piston is rotatable, so that the opening 10 or the second opposed opening 10' comes into congruence with the longitudinal groove 14 or the longitudinal groove 14' in both terminal positions of the pump piston 4.

In particular, in the event of a special form of failure of the actuation device 23 and/or of the electrical control device 24, resulting in a continued rotation of the sheath 18 and the piston 4 toward and beyond the full-load direction instead of being stopped at an intermediate position corresponding to a desired injection rate, the opening 10 or 10' again comes into congruence with the longitudinal groove 14 or 14', shortly before or just when the governor rod 22 reaches its end stop. Thus, with the occurrence of the noted failure, the supply of fuel can be set to zero, and the engine can be shut off.

The noted congruence can be realized either by increasing the conventionally provided rotational distance of the governor rod 22, or the pump piston 4, by means of an appropriate adaptation of the position of the end stops 25 and 26 (see FIGS. 1 and 3), or the pump piston 4 is modified, and while the rotational angle remains the same an additional longitudinal groove 14' is provided on the pump piston 4 in accordance with the embodiment shown in FIG. 2. When a so-called tiller control is used, provided with the tiller arm 20, the embodiment according to FIG. 2 is necessary because of the limited rotatability of the pump piston 4. The pump piston 4 can then have either the one oblique groove 15, or as also shown in FIG. 2 a second oblique groove or recess 15' as well, the latter having an oblique upper limitation edge 16'. The number of openings 10, 10' corresponds to this.

However, in order to attain a spill over of the supplied fuel quantity, that is, a return of the fuel quantity to the suction chamber 11, in the event of malfunctioning of the control device 24, it would be sufficient to have only one of the longitudinal grooves 14 or 14' with the wider width or, as shown in a further embodiment of the pump piston 4" in FIG. 2a, to provide at least one stop groove 14" with a widened section 14a". The section 14a" is designed in its length l such that in the maximum rotated position of the pump piston 4" and over its entire stroke range, the opening 10 connects the pump work chamber 6 with the suction chamber 11. The position thereby assumed by the opening 10 at the top dead center position of the pump piston 4" is indicated by dot-dash lines at 10" and is cut into the jacket face, here indicated by reference numeral 4a".

In the transitional zone between the oblique groove 15 and the longitudinal groove 14' in FIG. 2, or the widened section 14a" of FIG. 2a, is disposed a short horizontal groove 19 by means of which the maximum fuel quantity, for instance that required during starting, is limited. The starting groove is a known feature in injection pumps.

Thus in all the described variant embodiments, no fuel is supplied in the maximum rotated position of the pump piston 4 or 4", thus attaining the required protection against overloading the engine. This is particularly important, if the control device 24 is equipped with an I member (integral member) and the actuation device 23 includes an electro-hydraulic or electro-pneumatic adjusting member, in the event that the magnetic valve, for instance, seizes and/or the return flow of the control medium is blocked and the pump piston 4 thus travels to its maximum rotated position.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines, comprising:

a cylinder;

a pump piston mounted to reciprocate within the cylinder;

an adjusting device connected to the piston injection pump to alter the termination of the piston supply stroke by rotating the piston between no-load and maximum load terminal positions;

said cylinder having at least one fuel opening extending through a wall thereof;

said pump piston having an end face and an outer jacket surface extending from the end face, at least one longitudinal stop groove and one oblique groove formed in said outer jacket surface, said oblique groove extending over a circumferential portion of said jacket surface and oriented obliquely to said end face, said oblique groove communicating with said longitudinal stop groove, and stop means for limiting the rotation of the piston by said adjusting device at least at said maximum load terminal position, the location of said stop means and at least a portion of the width of said at least one longitudinal groove being related such that said at least one opening in the cylinder wall reaches a congruent relationship with at least said one longitudinal groove shortly before said maximum load terminal position is reached.

2. A fuel injection pump according to claim 1, wherein the piston is provided with two longitudinal grooves which serve as stop grooves assuring congruence with said at least one opening in the cylinder wall in either rotary terminal position of the piston.

3. A fuel injection pump according to claim 1, wherein the piston has two longitudinal grooves and the cylinder two openings, and wherein each opening reaches a congruent relationship with a respective longitudinal groove before either of said rotary terminal positions of said piston is reached.

4. A fuel injection pump as defined in claim 1, wherein a portion of the piston rotation is associated with engine full-load operation and another portion of the piston rotation is associated with engine idle operation, and wherein said at least one longitudinal groove serves as a limitation beyond the full-load portion of the piston rotation as well as before the idle portion thereof defining the no-load and the maximum load rotated position.

5. A fuel injection pump for internal combustion engines, comprising:

a cylinder;

a pump piston mounted to reciprocate within the cylinder;

an adjusting device connected to the piston injection pump for rotating the latter between terminal positions, a portion of the piston rotation being associated with engine full-load operation and another portion of the piston rotation with engine idle operation;

said cylinder having at least one fuel opening extending through a wall thereof;

said pump piston having an end face and an outer jacket surface extending from the end face;

at least one longitudinal stop groove and one oblique groove formed in said outer jacket surface;

said oblique groove extending over a circumferential portion of said jacket surface and being oriented obliquely to said end face and communicating with said longitudinal stop groove;

and stop means for limiting the rotation of the piston by said adjusting device beyond the terminal positions of the portions of the rotation associated with full load operation and idle operation, respectively;

said at least one longitudinal groove being located adjacent to the idle portion of the piston rotation and having a width such that congruence with said at least one opening in the cylinder wall is maintained at both terminal positions and thus over the entire stroke range of the piston.

6. A fuel injection pump as defined in claim 5, wherein said at least one longitudinal groove has a widened section, the width and length of which assures congruence with said at least one opening in the cylinder wall in the maximum rotated position of the piston and over the entire stroke range of the piston.

* * * * *